United States Patent [19]

Brinkmann et al.

[11] 3,995,679

[45] Dec. 7, 1976

[54] CONTINUOUS CASTING APPARATUS, AND A METHOD OF CASTING

[75] Inventors: Joseph Bernard Brinkmann, Oxford; Joseph Edward Byrnes, Fairfield, both of Conn.

[73] Assignee: General Electric Company, New York, N.Y.

[22] Filed: Dec. 20, 1974

[21] Appl. No.: 534,715

[52] U.S. Cl. ..... 164/86; 118/405; 164/268; 164/275; 427/434 E; 427/436

[51] Int. Cl.[2] ..... B22D 23/04; B22D 11/00

[58] Field of Search ..... 164/86, 268, 275; 118/404, 405; 427/404, 405, 434, 435, 436

[56] References Cited

UNITED STATES PATENTS

| | | | |
|---|---|---|---|
| 1,785,037 | 12/1930 | Martell et al. | 118/405 |
| 3,484,280 | 12/1969 | Carreker | 164/281 X |
| 3,561,399 | 2/1971 | Federman | 164/86 X |
| 3,598,085 | 8/1971 | Carreker | 118/405 |

FOREIGN PATENTS OR APPLICATIONS

| | | | |
|---|---|---|---|
| 839,556 | 6/1960 | United Kingdom | 164/275 |

*Primary Examiner*—Francis S. Husar
*Assistant Examiner*—Gus T. Hampilos
*Attorney, Agent, or Firm*—R. G. Simkins; P. L. Schlamp; F. L. Neuhauser

[57] ABSTRACT

Apparatus for and method of continuously casting metals by passing a metal core member through a container of molten metal, and thereby accreting and solidifying molten metal on the core member. The invention comprises providing venting means in the apparatus, and method steps for venting gas from portions of the container of molten metal.

10 Claims, 2 Drawing Figures

CONTINUOUS CASTING APPARATUS, AND A METHOD OF CASTING

BACKGROUND OF THE INVENTION

This invention relates to an improvement in apparatus and method for continuous metal casting according to the so-called "dip-forming process" of metal casting. The dip-forming system for the continuous casting of metal comprises supplying a body of molten metal and passing a metal core member through the molten metal and thereby accreting and solidifying molten metal on the core member.

The dip-forming process of continuously casting by moving a core member through a body of molten metal, and apparatus therefor, are the subjects of many prior U.S. patents, including:

| | | |
|---|---|---|
| 3,008,201 | 3,094,752 | 3,510,345 |
| 3,060,053 | 3,235,960 | 3,538,884 |
| 3,060,054 | 3,424,130 | 3,598,085 |
| 3,060,055 | 3,466,186 | 3,610,204 |
| 3,060,056 | 3,484,280 | 3,709,722 |
| | | 3,813,260 |

The disclosures of these U.S. patents are incorporated herein by reference.

The dip-forming process of continuously casting as heretofore practiced and provided for by the prior art apparatus and method of U.S. Pat. Nos 3,466,186 and 3,598,085 was found in some instances to produce a poor quality cast rod product. The deficiency incurred in such instances was a cast rod product having a rough and irregular surface comprising a high concentration of protrusions or bumps and depressions or hollows, and/or a porous consistency, rendering it unsuitable for certain uses such as the drawing of fine wire.

This method of casting is especially effective in the production of copper-containing rod for use in the manufacture of electrical conductors by passing a copper-containing core member through a melt containing copper.

SUMMARY OF THE INVENTION

This invention comprises the discovery of the source of the surface imperfections and/or porosity in certain cast rod products produced by the method and apparatus of U.S. Pat. Nos. 3,466,186 and 3,598,085, and of a remedy therefor. The invention, therefore, comprises improvements in the method and apparatus of the said U.S. Pat. Nos. 3,466,186 and 3,598,085.

The improvements of this invention include the discovery and recognition of the conditions which cause the surface irregularities and/or porosity in the case rod products of certain production systems, which apparently constitute an accumulation of gas within the system, and also specific means of overcoming such conditions, comprising the venting of such gas to eliminate the source of the irregularities.

OBJECTS OF THE INVENTION

A primary object of this invention is to provide an improved apparatus and method for continuously casting metals such as copper or alloys thereof by passing a metal core member through a container of molten metal, and thereby accreting and solidifying molten metal on the core member, which produce cast products having smooth surfaces free of irregularities.

Another object of this invention is to discover the cause of surface imperfections in the cast rod products of a continuous casting system and provide a means for overcoming the conditions responsible therefor.

A further object of this invention is to provide means for evacuating gas from a continuous casting apparatus and a method of evacuating gas from the system while carrying out the casting process.

DETAILED DESCRIPTION OF A PREFERRED EMBODIMENT

Figure 1:
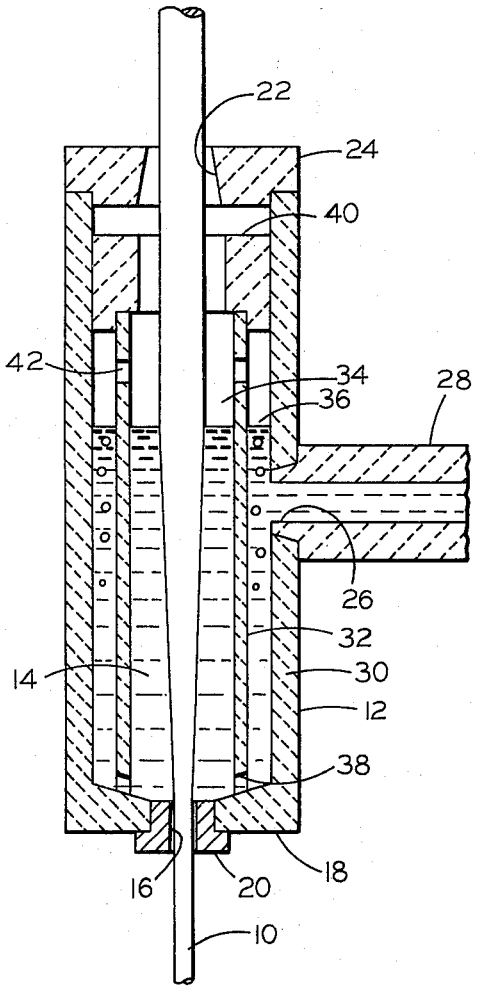
FIG. 1 is a sectional view with parts in elevation of a casting crucible illustrating one embodiment of this invention.

In the drawing, like numerals are used to identify like parts in each figure.

Referring to the drawing, a metal core member 10, such as a rod of copper or a copper alloy, is continuously passed upwardly through the apparatus of a continuous casting system including a crucible 12 for the containment of molten metal 14, such as copper or a copper alloy. As provided for in the dip-forming system of continuous casting, the molten metal 14 accretes and solidifies on the colder member 10 as the core member moves through the melt contained in the crucible 12.

The casting in this manner can increase the cross sectional area of the core member up to about twice its initial size, depending of course, upon the temperature differences between the core member and the melt, and the core member dwell time of passage within the melt, which in turn is dependent upon the speed of the core member moving through the melt and the depth of the melt or body of molten metal contained within the crucible.

Significant aspects of the dip-forming system of continuous casting comprises the reduction of the size or diameter of the enlarged cast rod product derived from the method by rolling means, and the typical dip-forming manufacturing practice of recycling rod through the system comprising repeated castings and rolling and drawing. The recycling of the product compounds the effects of imperfections and/or entrainment of foreign matter, and such deleterious conditions are highly critical when the cast product is subsequently drawn down to very fine diameter wire or conductors, which is a common use of the dip formed cast products.

The core member 10 enters crucible 12 through an entry port 16 or orifice typically located in the crucible's bottom wall 18. Entry port 16 is generally provided with a replaceable insert bushing member 20. Core member 10 passes through the molten metal contents 14 of the crucible 12, accumulating a cast layer thereon by the solidification of the melt on the cooler metal of the core, and then passes out of the crucible 12 through an exit port 22 located in an upper portion of the crucible such as its top wall member 24.

The crucible 12 is supplied with molten metal 14 from any suitable source, such as a melting furnace (not shown) and the melt is introduced into the crucible through a lateral feed inlet 26 connected with a supply tube 28 or launder adjoining the side wall 30 of the crucible. Molten metal 14 is supplied at a rate to maintain the crucible substantially full and at approximately the same level so as to provide for a uniform amount of casting by accretion and solidification on the core.

In accordance with the dip-forming system construction and inventions of U.S. Pat. Nos. 3,466,186 and 3,598,085, the crucible 12 is divided by a baffle member 32 into two chambers comprising an inner chamber 34 and an outer chamber 36. The inner chamber 34 is defined and established by the baffle 32, encloses the crucible entry port 16 and exit port 22 and the casting area about the path of travel of the metal core member 10 moving through the crucible 12 and its molten metal contents 14 from the entry port 16 to the exit port 22. The outer chamber 36 defined and established by the baffle 32, is adjacent the feed inlet 26 through which molten metal is introduced into the crucible 12 from a suitable source which is not shown. Outer chamber 36 comprises a heating zone wherein a heat source external to the crucible, such as the induction coils shown in the previously noted U.S. Pat. Nos. 3,466,186 and 3,598,085, increases or adjusts the temperature of the molten metal being introduced into the crucible 12 through opening 26. The baffle 32 has at least one and preferably several openings 38 or slots adjacent its bottom and in close proximity to the crucible entry 16 and the area of the initial contact or exposure of the core member 10 to the molten metal 14. The baffle 32 of one embodiment is annular in shape and disposed substantially concentrically to the crucible side wall 30 comprising a hollow cylinder extending from the crucible bottom wall 18 to above the level of its molten metal contents 14 in accordance with the construction shown in U.S. Pat. Nos 3,446,186 and 3,598,085. Baffle 32 is also provided with a baffle spacer and top unit 40 such as illustrated in the aforesaid patents. Also as shown in these patents, the inner and outer chamber 34 and 36 defined and established by the baffle 32 dividing the crucible contents, preferably are concentrically arranged with the outer chamber surrounding or circumscribing the inner chamber.

The function of the baffle 32 dividing the crucible 12 into an inner chamber 34 and an outer chamber 36 is as set forth and described in detail in the said U.S. Pat. Nos. 3,446,186 and 3,598,085. Specifically, the baffle structure defines and establishes a flow pattern of the molten metal 14 downward from the feed inlet 26 past a heating zone of the outer chamber 36, through opening 38 in the bottom of the baffle 32, and countercurrently upward in the interior casting zone of the inner chamber 34 about the core member 10 passing therethrough.

The dip-forming system for continuous metal casting described, and also disclosed in the said U.S. Pat. Nos. 3,446,186 and 3,598,085, in certain instances or manufacturing facilities produced cast rod products having surface imperfections comprising protrusions or bumps and depressions or hollows, and porous cast layers. Moreover, the encountered irregularities were substantially accentuated and enlarged with each recycling of the core member to the extent that an inferior grade product became unsuitable for its intended purpose, the drawing of fine diameter wire such as about 0.064 inch in diameter.

This invention accordingly comprises the discovery of the cause of such surface imperfections and the finding of an effective means of overcoming their cause. In accordance with this invention it was discovered that oxygen contained or entrained within the molten metal apparently reacts with the graphite components of the dip-forming apparatus such as the graphite supply tube 28 or launder, forming carbon monoxide and/or carbon dioxide. The carbon monoxide and/or carbon dioxide, and possible other gases such as water vapor, initially migrate to and accumulate in the upper portion of the outer chamber 36, becoming trapped between the baffle member 32 and the crucible 12. However, as the concentration of the carbon monoxide and/or carbon dioxide increases, bubbles of the gas become increasingly entrained within the molten metal and are then carried downward along the outer chamber 36, through the baffle openings 38 and into the inner casting chamber 34 containing the moving core member 10 and the accreting and solidifying melt on the core member. The gas bubbles nucleate on the core rod simultaneously with the accretion and solidification of the molten metal thereon whereby pores or gas-containing pockets or cells are formed and which frequently expand within the cast section or layer producing bumps or holes and pocks over its surface. This degrading condition which is attributable to the envelopment of insoluble gas bubbles within the casting is greatly accelerated and compounded by the recycling of the cast product wherein lubricants are applied to the cast rod product for drawing and thus entrapped within small pores or pocks and upon recasting are vaporized and further enlarges the cavity or pock.

Other than reducing the oxygen content of the melt which may or may not be practical depending upon the source of the oxygen, it was found that this degrading condition in the dip-forming system for continuous metal casting and the impaired product thereof could be effectively and economically overcome by evacuating gas from the upper area of the outer chamber of the crucible between the side wall thereof and the baffle and above the level of the molten metal contents therein.

The evacuation of gas from the outer chamber 36 in one embodiment of this invention is achieved by providing at least one and preferably a plurality of outlet ports 42 or vents passing through the upper portion of baffle 32 above the level of the crucible's molten metal contents substantially as shown in FIG. 1. This provides the outer chamber 36 with a vent or discharge opening leading to the crucible exit port through the inner chamber 34 for the discharge of gas.

For instance, in a dip-forming continuous copper casting factory production operation the effects of the concentration of insoluble gas within the system, and in particular the outer chamber 36 between the crucible and baffle, had previously rendered the cast product useless for its intended purpose, the drawing of fine wire of about 0.064 of an inch in diameter, thereby shutting down the production operation. This discovery of the cause of this impediment and application of the measures of this invention, as described hereinafter, resolved the difficulties and resulted in the resumed production of high quality cast copper products suitable for fine wire drawing.

Specifically, eight outlet ports measuring ¼ inch in diameter were drilled through the upper section of the baffle as illustrated in FIG. 1 above the operating level of the melt. The presence of these venting outlet ports provided for the evacuation of undesired gas such as carbon monoxide from the outer chamber, through the upper portion of the inner chamber and its discharge out the cast rod exit port. This arrangement effectively continuously dissipated the insoluble gas such as carbon monoxide and/or carbon dioxide attributable to oxygen entrained within the melt, into the outer atmosphere thereby enabling the formation of a sound cast copper rod of high quality in routine production.

Figure 2:
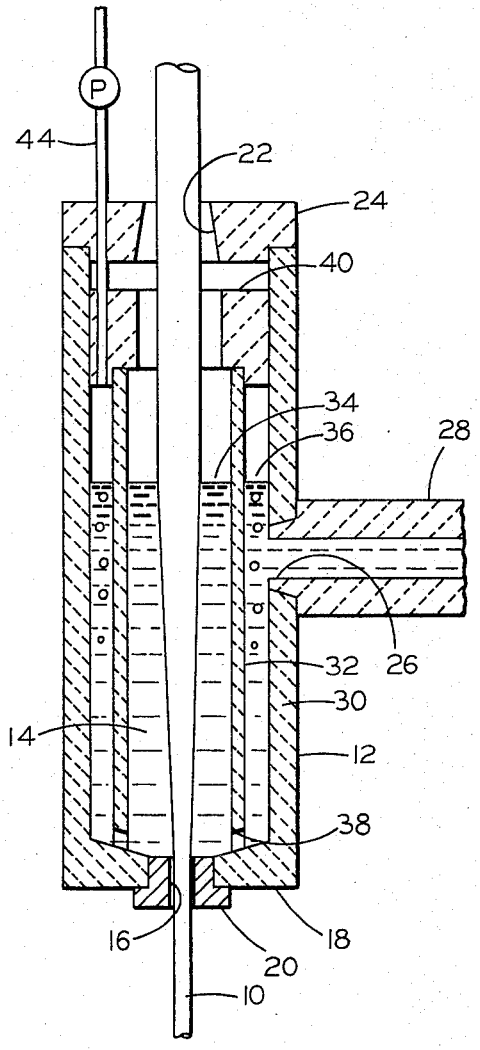
FIG. 2 is also a sectional view, with parts in elevation, of a casting crucible illustrating another embodiment of this invention.

Referring to FIG. 2, a further embodiment of this invention comprises the installation of a vent passage such as conduit 44 extending from within outer chamber 36, through the crucible wall whereby the gas can be evacuated directly out from the crucible. Also this arrangement provides for the use of vacuum means such as a pump P to apply a subatmospheric pressure to the upper portion of the outer crucible chamber 36 above the level of the melt to facilitate the removal of undesired gases.

Although the invention has been described with reference to certain specific embodiments thereof, numerous modifications are possible and it is desired to cover all modifications falling within the spirit and scope of the invention.

What we claim as new and desire to secure by Letters Patent of the United States is:

1. Apparatus for the continuous casting of metal comprising copper by passing a copper containing metal core member through a body of molten metal containing copper and thereby accreting and solidifying molten metal having a substantially smooth surface free of irregularities on the core member, comprising:

a. an enclosed crucible for the containment of molten metal containing copper having an entry port in a bottom wall thereof and an exit port in a top wall thereof for the passage of a copper containing metal core member through the enclosed crucible and molten metal contents thereof, and having a feed inlet in a side wall thereof for the introduction of molten metal containing copper into the crucible;

b. a baffle within the crucible extending from the crucible bottom to above the molten metal contents thereof defining and establishing an inner chamber enclosing the crucible entry port and exit port and a casting area about a copper containing metal core member moving through the crucible and its copper containing molten metal contents from the entry port to the exit port of the crucible and defining and establishing an outer chamber adjoining the feed inlet for the introduction of molten metal containing copper, said baffle having at least one opening adjacent its bottom for the passage of molten metal containing copper from the feed inlet through the outer chamber of the crucible to the inner chamber thereof; and c. means communicating with the interior of said crucible for evacuating gas from the upper area of the outer chamber of the crucible above its contents of molten metal containing copper.

2. The continuous casting apparatus of claim 1, wherein the means for evacuating gas from the upper area of the outer chamber of the crucible above the copper containing molten metal contents thereof comprises at least one outlet port through an upper portion of the baffle above the crucible's contents of copper containing molten metal and thereby providing said outer chamber with a vent to the crucible exit port through the inner chamber.

3. The continuous casting apparatus of claim 1, wherein the means for evacuating gas from the upper area of the outer chamber of the crucible above the copper containing molten metal contents thereof comprises a vent passage extending from an upper portion of the outer chamber of the crucible above its copper containing molten metal contents through the crucible enclosure.

4. The continuous casting apparatus of claim 3, wherein the vent passage comprises a conduit for evacuating gas from the upper area of the outer chamber which is connected with means for providing a subatmospheric pressure to draw gases from said outer chamber.

5. Apparatus for the continuous casting of copper metal by passing a copper metal core member through a body of molten copper metal and thereby accreting and solidifying molten copper metal having a substantially smooth surface free of irregularities on the copper core member, comprising:

a. an enclosed crucible for the containment of molten copper metal having an entry port in a bottom wall thereof and an exit port in a top wall thereof for the passage of a copper metal core member through the enclosed crucible and molten copper metal contents thereof, and having a feed inlet in a side wall thereof for the introduction of molten copper metal;

b. an annular baffle positioned substantially concentrically within the enclosed crucible and extending from the bottom wall of the crucible to above the molten metal contents thereof defining and establishing an inner chamber enclosing the crucible entry port and exit port and a casting area about a copper metal core member moving through the crucible and its molten copper metal contents from the entry port to the exit port of the crucible and defining and establishing an outer circumscribing chamber adjoining the feed inlet for the introduction of molten copper metal, said baffle having a plurality of openings adjacent its bottom for the passage of molten copper metal from the feed inlet through the outer chamber of the crucible to the inner chamber thereof; and c. means communicating with the interior of said crucible for evacuating gas from the upper area of the outer chamber of the crucible above its contents of molten copper metal.

6. The continuous casting apparatus of claim 5, wherein the means for evacuating gas from the upper area of the outer chamber above its contents of molten copper metal comprises a plurality of outlet ports through an upper portion of the annular baffle above the crucible's contents of molten copper metal and thereby providing said outer chamber with a vent to the crucible exit port through the inner chamber.

7. The continuous casting apparatus of claim 5, wherein the means for evacuating gas from the upper area of the outer chamber above its contents of molten copper metal comprises a vent conduit extending from an upper portion of the outer chamber of the crucible above its molten copper metal contents and through the crucible enclosure.

8. A method of continuously casting molten copper metal comprising passing a copper metal core member through a crucible containing molten metal and thereby accreting and solidifying the copper melt having a substantially smooth surface free of irregularities on the copper core member, comprising the steps of:

a. providing an enclosed crucible containing molten copper metal and having an entry port and an exit port for the passage of a copper metal core member through the crucible and molten copper metal contents thereof;

b. establishing in said crucible an interior casting zone of the molten copper metal through which the copper metal core member passes when moving from the entry port to the exit port through the crucible and its molten copper metal contents and a substantially concentrically disposed exterior heating zone of the molten copper metal provided by an annular baffle extending from the bottom of the crucible to above the molten metal contents thereof and having a plurality of openings therein at its lower end for the movement of molten copper metal between said zones;

c. introducing molten copper metal into the upper portion of said exterior zone and maintaining both zones subtantially full;

d. passing a copper metal core member through the interior casting zone of the crucible and molten copper metal contents thereof and thereby accreting and solidifying the copper melt on the copper metal core member with a substantially smooth surface free of irregularities;

e. establishing a flow of molten copper metal downward in said exterior heating zone, through the openings in the lower end of the baffle and countercurrently upward in said interior casting zone; and f. evacuating gas from the upper area of the concentrically disposed external heating zone above the molten copper metal contents thereof.

9. The method of continuous casting of claim 8, wherein the gas is evacuated from the upper area of the concentrically disposed external heating zone above the molten copper metal contents thereof by providing at least one outlet port through an upper portion of the annular baffle.

10. The method of continuous casting of claim 8, wherein the gas is evacuated from the upper area of the concentrically disposed external heating zone above the molten copper metal contents thereof by providing a vent conduit extending from an upper portion of the outer chamber of the crucible through the crucible enclosure.

* * * * *